US005758974A

United States Patent [19]

Markowitz

[11] Patent Number: 5,758,974

[45] Date of Patent: Jun. 2, 1998

[54] EXPANDABLE INSERT FOR SUPPORTING LUGGAGE

[76] Inventor: Edward Markowitz, 277 Prospect Ave., Hackensack, N.J. 07602

[21] Appl. No.: 711,022

[22] Filed: Sep. 9, 1996

[51] Int. Cl.[6] ..... B65D 33/02

[52] U.S. Cl. ..... 383/127

[58] Field of Search ..... 229/120.15, 199, 229/120.18; 383/127, 35, 33, 104, 119

[56] References Cited

U.S. PATENT DOCUMENTS

| | | | |
|---|---|---|---|
| 3,446,414 | 5/1969 | Omori | 229/120.15 |
| 4,142,564 | 3/1979 | Zoland | 383/127 |
| 5,322,362 | 6/1994 | Smith | 383/127 |
| 5,400,906 | 3/1995 | Tang | 383/2 X |

FOREIGN PATENT DOCUMENTS

| | | | |
|---|---|---|---|
| 560830 | 4/1944 | United Kingdom | 229/120.15 |

*Primary Examiner*—Jes F. Pascua

*Attorney, Agent, or Firm*—Kirschstein, et al.

[57] ABSTRACT

An insert for use within a relatively soft article of manufacture for lending support to the article from within to keep it in its expanded state includes a main panel dimensioned for substantially conforming juxtaposition with one of the wall of the article when the inserted position within the article, and a pair of auxiliary panels mounted by respective pivoting regions on opposite end zones of the main panel for pivoting between their respective collapsed positions in which they are juxtaposed with the main panel and at least their deployed positions in which they extend substantially normal to the main panel and, when the insert is accommodated in the article, are substantially conformingly juxtaposed with respective associated ones of the walls of the article that adjoin the aforementioned one wall.

18 Claims, 3 Drawing Sheets

FIG. 1
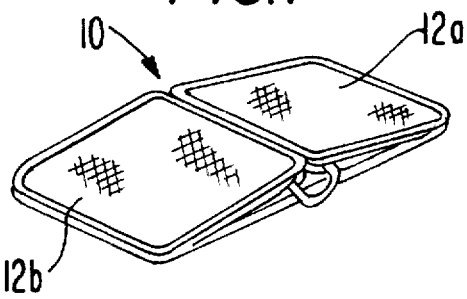
FIG. 2
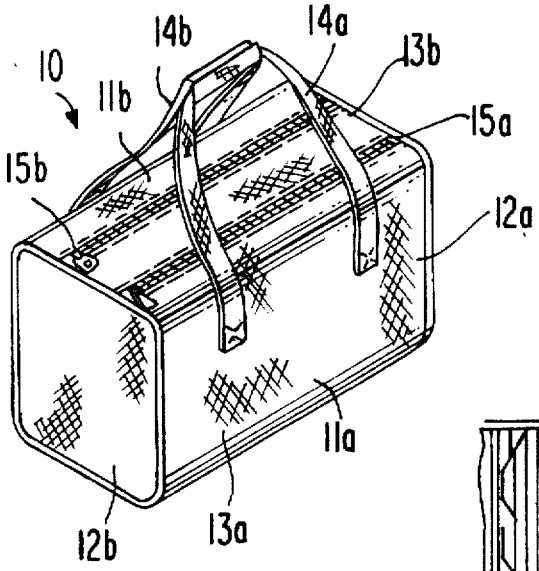
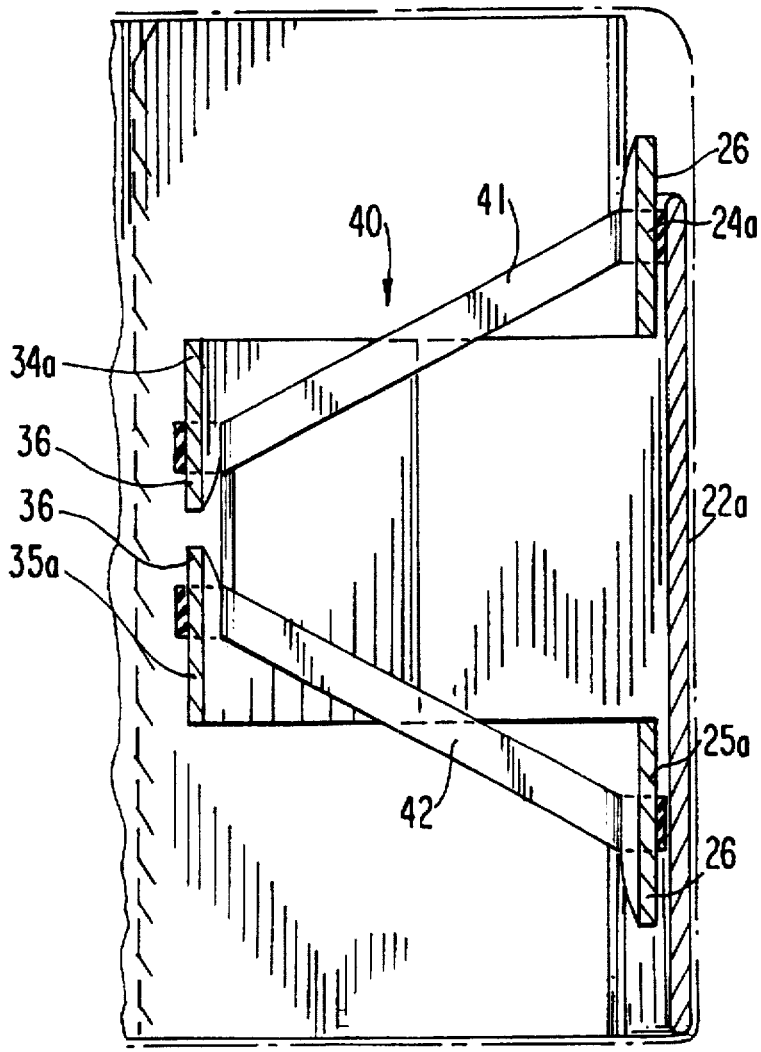
FIG. 4

EXPANDABLE INSERT FOR SUPPORTING LUGGAGE

BACKGROUND OF THE INVENTION

1. Field of the Invention

The present invention relates to the field of displaying luggage of the relatively soft kind in general, and more particularly to an expandable insert for use to support from within the respective piece of luggage that is to be prominently displayed in an expanded state.

2. Description of the Related Art

There are already known various constructions of internally located supports or inserts of this type, such as those revealed in U.S. Pat. Nos. 4,077,451, 4,141,399, 4,142,564 and 5,350,241 all to Zoland; and 4,946,292, 4,969,751, 4,993,846 and 5,030,014 all to Diamond et al, and in U.S. design Pat. Des. 254,894 and Des. 266,034 both again to Zoland. What these patents have in common with each other and with the present invention is that they disclose internal supports designed to occupy a minimum amount of space when in their collapsed condition corresponding to a similar state of the piece of luggage in which they are accommodated, and to support the luggage piece, which would otherwise be bendable, crinkleable or otherwise easily deformable, even under its own weight, from within, to maintain it in its expanded, essentially taut, aesthetically pleasing to the eye, state in which it is to be presented to prospective purchasers when on display at the point of sale. For the most part if not in all cases, such inserts also include biasing means of one sort or another that urge the various parts of the insert toward their deployed positions in which they perform their aforementioned supporting function.

While it may be true that the inserts or expanders of the types disclosed in these patents perform to satisfaction in the applications for which they have been designed, experience has shown that they are not that well suited for other applications. This is believed to be attributable mainly to the fact that the parts of the inserts that will be referred to herein as side panels, if present at all, perform at most a limited, if any, role in the actual support of the bag; rather, they are primarily intended merely as interconnections between the main-load bearers, that is the insert parts that will be referred to as the rear and the front panels. In addition to this, the presence of these side panels, with their limited utility, in the insert, is a luxury that has to be paid for dearly in freight costs in instances when the space is at a premium, that is when freight charges are paid based on the weight and/or space occupied by the items being transported (including any contents of such items).

OBJECTS OF THE INVENTION

Accordingly, it is a general object of the present invention to avoid the disadvantages of the prior art.

More particularly, it is an object of the present invention to provide a foldable internal support or insert for supporting an otherwise relatively soft article of manufacture, particularly a piece of luggage, from within, when such item is to be displayed to the public, which support does not possess the drawbacks of the known temporary supports of the aforementioned type.

Still another object of the present invention is to devise an insert of the type here under consideration which is capable of holding the item on display in a virtually impeccable view condition.

It is yet another object of the present invention to design the above insert in such a manner as to take up a minimum amount of space when not deployed to support the luggage piece in its expanded state.

A still further object of the present invention is to develop an insert of the above type which can be easily or even automatically deployed from its collapsed condition and yet will reliably stay in its deployed condition even as the item it is supporting from within is being handled.

Yet another object of the present invention is to equip the insert of the present invention, which is a disposable item after it has outlived its usefulness, with means for facilitating its removal from the interior of the article.

A concomitant object of the present invention is so to construct the insert of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in an insert for use within a relatively soft article of manufacture having respective substantially sheet-shaped walls meeting at respective corners and along respective corner lines for lending support to the article from within to keep it in its expanded state, and in the assembly of such a support with the article.

According to the present invention, the insert includes a main panel dimensioned for substantially conforming juxtaposition with one of the walls of the article when the insert is in its inserted position within the article. A pair of auxiliary panels is mounted by respective pivoting regions on opposite end zones of the main panel for pivoting between their respective collapsed positions in which they are juxtaposed with the main panel and at least their deployed positions in which they extend substantially normal to the main panel and, when the insert is accommodated in the article, are juxtaposed with respective associated ones of the walls of the article that adjoin the aforementioned one wall. Each of the auxiliary panels substantially conforms in its outer dimensions to those of the respective one of the associated walls of the article so as to engage at least the three-side corners of the article that are remote from the main panel.

A pair of corner pieces each situated at and/or next to one of the end zones and including two substantially sheet-shaped parts pivotably joined to one another at a hinge region is individually hingedly connected with the main and the respective one of the auxiliary panels at locations remote from the corresponding one of the end zones. Each of the corner pieces is inverted with respect to the relative positions of the main and auxiliary panels to extend into the space delimited by the main and auxiliary panels to an extent increasing with the extent of pivoting of the respective auxiliary panel toward its collapsed position.

A particularly advantageous embodiment of the present invention is obtained when each of the pivoting and hinge regions situated at or on the respective one of the corner pieces includes at least one promontory; and when there is further provided at least one resilient biasing element connected to the promontories of the pivoting and hinge regions to urge the respective one of the auxiliary panels toward the deployed position thereof with a force that increases with the increasing distance of the promontories from one another and hence with the extent of pivoting of the respective auxiliary panel toward its collapsed position. Advantageously, the biasing element is constituted by an endless elastic element trained around the promontories of the pivoting and hinge regions.

Another feature of the present invention may be found in the contemplated provision of each of the pivoting and hinge regions in the form of a pair of separate and spaced portions. In this context, an especially advantageous implementation of the concept discussed just before is obtained when each of the separate portions of each of the pivoting and hinge regions situated at or on the respective one of the corner pieces includes at least one promontory, and when there are provided at least two resilient biasing elements each connected to a different one of the promontories of the pivoting and hinge regions to urge the respective one of the auxiliary panels toward its deployed position with a force that increases with the increasing distance of the promontories from one another and hence with the extent of pivoting of the respective auxiliary panel toward its collapsed position. Even here, it is advantageous when each of the biasing elements is an endless elastic element trained around the respective ones of the promontories of the separate portions of the pivoting and hinge regions.

According to another aspect of the present invention, the main panel has incorporated in it destructible separation means for separating the otherwise integral main panel into at least two separate constituent parts upon deliberate destruction of such separation means. It should be appreciated that such a deliberate disintegration of the main panel, which is not intended to take place until the insert has outlived its purpose on the transfer of ownership of the article to its purchaser, facilitates the removal of the dispensable insert from the interior of the article. Such separation means advantageously includes at least one weakened portion situated between the constituent parts. It is advantageous when the weakened portion is constituted by at least one row of perforations. However, it is especially advantageous for the weakened portion to be constituted by a tear-off strip situated between the constituent parts and separated from them by respective rows of perforations.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a perspective view of a piece of luggage incorporating the present invention in its collapsed or transportation state;

FIG. 2 is a perspective view corresponding to that of FIG. 1 but showing the luggage piece in its expanded or display state;

FIG. 4 is sectional view taken on line 4—4 of FIG. 3; and

DETAILED DESCRIPTION OF THE PREFERRED EMBODIMENT

Figure 3:
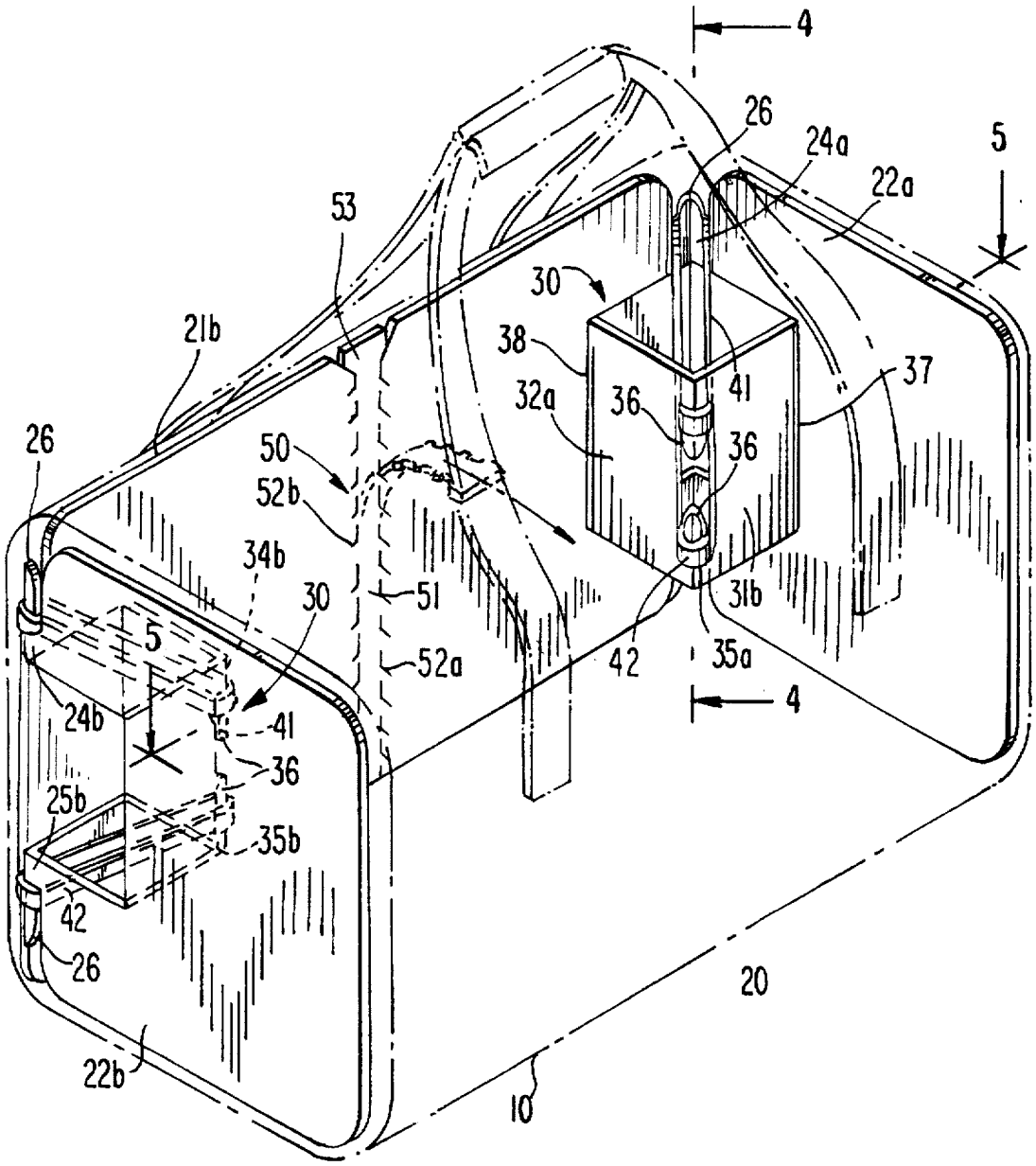
FIG. 3 is a view similar to but drawn to a scale exceeding that of FIG. 2, and showing the luggage piece proper merely in phantom lines whereas an expander insert included within the luggage piece and embodying the present invention is shown in solid lines.

Referring now to the drawing in detail, and first to FIGS. 1 and 2 thereof, it may be seen that the reference numeral 10 has been used therein to identify a piece of luggage incorporating the present invention, in its entirety. The luggage piece 10 may be of any suitable size for use as a suitcase, garment bag, carry-on luggage, handbag or even a purse, of any desirable material such as a variety of textile materials, real or artificial leather and similar materials, with the only limitation being that the luggage piece 10 (and preferably the material it is made of) be flexible enough to permit flattening of the luggage piece 10 into its collapsed state illustrated in FIG. 1 and its subsequent deployment into its expanded state depicted in FIG. 2.

It may be seen especially in FIG. 2 of the drawing that the luggage piece 10 (hereafter referred to as a bag for convenience) has a generally parallelepiped configuration when in its expanded state, including respective front and rear walls **11*a* and 11*b*, a pair of opposing side walls 12*a* and 12*b*, a bottom wall 13*a*, and a top wall 13*b*. Of course, these references, as well as others that may be encountered here with respect to relative positions of any portions or parts, directions, or similar or other spatial positioning information, are to be understood to be with respect to that orientation which the bag 10** (and/or its contents) assumes when stored, transported and/or displayed, as the case may be, and which corresponds to that illustrated in the drawing, yet with a possibility of reversal or shifting between what is considered to be front and rear and/or side. Moreover, while it has been established above for reference purposes only what is to be called "front", "rear" and "side" throughout this description, this convention need not necessarily correspond to what is understood under these terms by the industry in general and by the prospective purchasers in particular.

To complete the picture, it is to be mentioned further that the bag 10 also includes at least one strap or a similar holding means to be used to tote, carry or lug the bag 10 around both prior to sale and especially after it, when used for the intended purpose of accommodating a variety of items that are to be transported from one location to another, and some, advantageously closable, access means for providing ingress and egress routes for such items into and out of the interior of the bag 10 and/or any compartment(s) it may contain or be subdivided into, or, generally speaking, access to such interior and/or compartments. In the embodiment of the bag 10 that is shown in the drawing, the holding means is shown to be constituted by a pair of handles **14*a* and 14*b* that are secured at their respective ends to the front wall 11*a* and to the rear wall 11*b* of the bag 10, respectively, while the aforementioned access means is constituted by two slit-like openings (not specifically shown) that are shown to be closed by respective slide fastener devices (commonly referred to as "zippers") 15*a* and 15*b*. Of course, due to the postulated flexibility of the bag 10 (and especially of the top wall 13*b* and of its material), the slit-shaped openings when open can be widened to the extent necessary to get the desired items into or out of the bag 10** as desired.

As mentioned before, the main reason for keeping the bag 10 in its collapsed state while in storage and especially while in transit between a manufacturing plant and the initially contemplated final destination of such article, that is a retail establishment, such as a luggage shop, department store, etc., is to keep the amount of space occupied by the bag 10 under these circumstances, and hence the storage and/or transportation costs associated with the volume occupied, to a minimum. On the other hand, as also already indicated, it is often desirable to put the bag 10 into and maintain it reliably in its expanded state of FIG. 2 at the actual point of sale, that is the location of the retail establishment at which the potential purchaser is to be exposed to it (as distinguished from any back room or other storage facility at which the store or shop may store their merchandise prior to actually putting it "on the floor").

Now, as stated before, the bag 10 (and preferably the material it is made of) is to be flexible enough to render the collapsing and expanding action possible; yet, this very flexibility would entail severe difficulties as far as the maintenance of the bag 10 in its expanded condition is concerned, if the bag 10 were to rely on its own inherent strength to sustain the expanded shape that may be initially imposed on it, provided that such imposition would be possible at all. Under these conditions, the flexible bag 10 would almost invariably sag or even collapse even if put on display by itself, and any stacking of similar or dissimilar bags 10 of the same or similar type to reinforce the appeal that such display may have to the customer would simply be out of the question.

This is why the bag 10 is not "left to its own devices" but rather has included in it an expanding insert 20 that can be seen particularly well in a general overview in FIG. 3 of the drawing. As mentioned before, the insert 20 is accommodated in the interior of the bag 10, the latter having been indicated in FIGS. 3 to 5 only by broken lines representing respective edges, seams or outline lines of the bag 10 in order not to obscure the features of the insert 20. The insert 20 as illustrated includes as its main components, using the same convention as before, a rear panel **21*b* that will also be referred to as a main panel, and a pair of side panels 22*a* and 22*b* also called the auxiliary panels. It is to be noted that the rear panel 21*b* is not shown to have any "front" counterpart (so that the corresponding reference numeral 21*a* is missing as well) and yet carries a suffix b. This, in conjunction with using the same second digit in the respective reference numerals, has been used to indicate kinship or association, and immediate or eventual juxtaposition and cooperation, of the rear panel 21*b* and of the side panels 22*a* and 22*b* of the insert 20 with the rear wall 12*b* and the side walls 12*a* and 12*b* of the bag 10**, respectively.

The panels **21*b*, 22*a* and 22*b* are of the same material (or even of different or even dissimilar materials, if so preferred for some reason), such as cardboard, corrugated cardboard or the like, the only requirement being that this material be relatively stiff (albeit not necessarily totally rigid) so as to perform its desired function, i.e. to reinforce the bag 10 and support and maintain it in its expanded display state illustrated in FIGS. 2 to 5 upon its deployment. The side panels 22*a* and 22*b* are connected to the rear panel 21*b* by respective hinge portions 24*a* and 25*a*, and 24*b* and 25*b* (only the first one and the latter two being specifically shown and designated in FIG. 3) that enable the side panels 22*a* and 22*b* to pivot about them between their positions corresponding to the collapsed and expanded states of the bag 10. The hinge portions 24*a* to 25*b* are provided with respective promontories or noses that are indicated at 26 without differentiating among them. The purpose these promontories 26** serve will be explained later.

Between the respective hinge portions **24*b* and 25*b* (and, correspondingly, the hinge portions 24*a* and 25*a*), there are located respective box-shaped corner pieces 30 (there is no need to differentiate between them and/or their portions because they both serve the same purpose albeit at different locations). While the corner pieces 30 could be constituted by members separate and apart from the rest of the insert 20 and secured in proper positions relative thereto by any suitable attachment means, such as staples, adhesive or the like, it is currently preferred, for the sake of economy of manufacture as well as further reduction of the bulk of the insert 20 without sacrificing its reinforcing function, for the corner pieces 30 to be constituted by integral portions of the insert 20 that are, however, partially separated from the rest of the insert 20 at their top and bottom regions as considered in FIG. 3**.

In any event, each of the corner pieces 30 includes two sheet-shaped parts **31*b* and 32*a* (or 32*b* in the case of the corner piece 30 that is shown only in broken lines) designated so in order to indicate their functional kinship with the rear and side panels 21*b* and 22*a* (or 22*b*). Bearing in mind that the two corner pieces 30 are structurally identical or similar to one another and that they perform the same function, the further discussion of them will be mostly limited to that one of them that is clearly visible in FIG. 3; however, it is to be understood that the following description is equally applicable, with possible adjustment in the respective reference numeral suffixes, to the other corner piece 30** as well.

It may be seen that the corner piece 30 is actually inverted as compared to the mutual position of the panels **21*b* and 22*a*. This means that, even though the part 31*b* has been actually cut out of the side panel 22*a*, it extends parallel to the rear panel 21*b* (whence its reference numeral 31*b*). Similar reasoning is also applicable to the part 32*a* (cut out of 21*b* but parallel to 22*a*). Like the side and rear panels 22*a*, 22*b* and 21*b*, the parts 32*a*, (32*b*) and 31*b* are joined with each other by respective hinges 34*a* and 35*a* (34*b* and 35*b*) shown to be equipped with respective promontories 36 of their own. Moreover, the illustrated parts 31*b* and 32*a* (as well as the non-illustrated ones) are joined to their panels 22*a* and 21*b* of origin by respective additional hinges 37 and 38 that enable them to pivot in their inverted positions in the manner indicated at the right side of FIG. 5 of the drawing concurrently with the pivoting of the side panel 22*a* (or 22*b***, as the case may be).

It may be seen that the insert 20 would be fully functional in its condition as described so far for maintaining the bag 10 in its expanded display state; it would just require some initial human involvement in the deployment, and the promontories 26 and 36 would serve no apparent purpose in this scenario and hence could be omitted. More particularly, upon arrival of the bag 10 with the insert 20 already in it at the destination at which it is to be displayed, or upon introduction of the insert 20 into the bag 10 at such a location, and just prior to the actual display of the particular bag 10, the person in charge of arranging the display (or his or her helper) would have to physically move both of the side walls **12*a* and 12*b* apart, usually simultaneously or one after another, thereby jointly moving the side panels 22*a* and 22*b* from their initial positions in which they are juxtaposed with the rear panel 21*b* into their final positions depicted in FIG. 3 in particular in which they extend substantially normal to the rear panel 21*b***.

It is also contemplated that rather than grabbing the side walls **12*a* and 12*b*, one can open the bag and insert his or her hand therein to move the side panels 12*a* and 12*b*** apart.

After that, friction between the bag 10 and the insert 20, coupled with the anti-return activity of the hinges **24*a*, 25*a*, 34*a* and 35*a* (or 24*b*, 25*b*, 34*b* and 35*b*) due to their natural tendency to oppose movement toward a position in which their material would be more stressed, will maintain the insert 20 in its thus deployed condition so that the latter will, in turn, perform its intended function of preventing the bag 10** from sagging or becoming otherwise distorted.

It should be mentioned at this juncture that the aforementioned absence of the front panel (**21*a*) is of no significant or apparent detriment as far as the supporting function of the insert 20 is concerned because it is generally sufficient if the bag 10 is supported just at those corners at which respective three of the sides meet; support in between, while also desirable, is not absolutely essential. However, to make absolutely sure that any unwelcome deterioration of appearance of the bag 10 when on display, if such should occur, will not make an unfavorable impression on potential purchasers, it may be best, and it is recommended, to put what was referred to as the "front" wall 21***a* of the bag 10 on display into a position (like in the "rear" or at the "bottom") in which it is not visible to such a person.

Despite the basic functionality of the insert 20 as described so far, it is proposed according to an additional feature of the present invention, to automate the deployment of the insert 20 at least to a large extent (performance of some "finishing touches" by humans, especially those aimed at completing insufficient deployment, may still be required at least now and then or under certain conditions), and to make the retention of the insert 20 in its deployed condition even more secure, by employing biasing means 40 designed to urge the insert towards its deployed condition. It is in this respect that the inverted condition of the respective corner piece 30 is being utilized to its best advantage.

Figure 5:
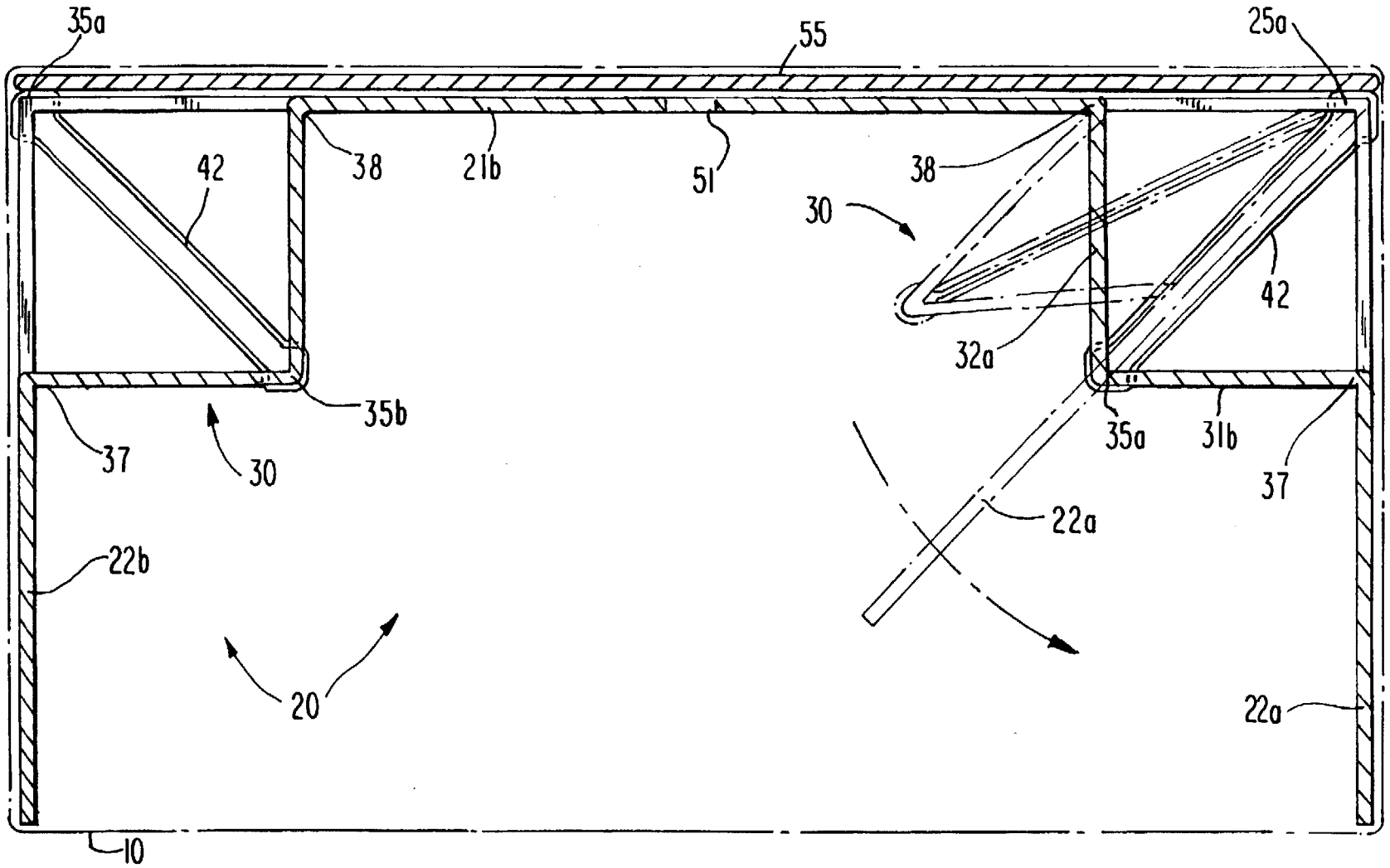
FIG. 5 is another sectional view akin to that of FIG. 4 but taken along lines 5—5 of FIG. 3.

As will certainly be appreciated from a consideration of FIGS. 4 and 5 of the drawing, the distance between the hinge portions 25*a* and 35*a* (and, by the same token, between the hinge portions 24*a* and 34*a* that are outside the visible area in FIG. 5) increases as the side wall 22*a* approaches the rear wall 21*b*. This effect was chosen deliberately in order to accomplish the desirable biasing action in a relatively simple but highly reliable manner by the biasing means 40 of the present invention, utilizing the aforementioned promontories 26 and 36 for this purpose.

More particularly, such biasing means 40 includes two endless (i.e. loop-shaped) resilient elements 41 and 42, especially rubberbands, each of which is trained around an associated pair of "upper" and "lower" promontories 26 and 36, respectively. It is relatively easy to place the resilient elements 41 and 42 on and around the promontories 26 and 36 in that the angle which the respective side panel such as 22*a* includes with the rear or back panel 21*b* can be obtuse, even significantly so, under these circumstances, because this biasing means mounting operation is typically, if not always, performed prior to the introduction of the insert 20 into the bag 10. Of course, as the side panel such as 22*a* is moved in the direction opposite to that indicated by an arrow in FIG. 5, the distance between the respective promontories 26 and 36 increases, and as a consequence the biasing elements 41 and 42 are expanded with attendant increase in their strain and stress that reach their maxima when the side panel such as 22*a* is juxtaposed with the rear panel 21*b*.

Of course, this creates a permanent tendency on the part of the insert 20 to self-deploy, and this tendency must be countered in one way or another until the time arrives that such a deployment is desired. This can be achieved, in a manner that is well known to those active in this field, either by merely positioning/stacking the bag 10 with the folded insert 20 in it in such a manner (such as with the side walls 11*a* and 11*b* facing up as shown in FIG. 1) that the forces of gravity and frictional forces defeat such a tendency, or better yet for folded bag handling purposes, by wrapping a constraining element (not shown) which may be as simple as a string, a cord or a packaging strap or two, around the folded bag 10 or a bundle of such bags 10, or by inserting the folded bag in a snug-fitting packaging sleeve which is particularly beneficial because it maintains the folded bag clean. Then, the removal of the constraint will permit and actually cause the insert to self-deploy in the manner indicated by the aforementioned arrow in FIG. 5 of the drawing with respect to the side wall 12*a*, and hence confer the desired display shape and appearance onto the bag 10.

Now, experience has shown that, while the introduction of the insert 20 into the bag 10 is relatively easy, especially since the insert is in its folded condition at that time, the removal of the insert 20 after it has been deployed may be somewhat more problematical, especially because there is no easy way to grip the side panels 22*a* and 22*b* prior to moving them toward their folded or collapsed positions. In this respect, it ought to be noted that, for the panels 22*a* and 22*b* to impeccably perform their functions, their outer edges must snugly (or at least almost so) fit into the respective inner corners of the bag 10, thus leaving precious little room, if any, for going around them in an effort to move the side panels 22*a* and 22*b* in the desired (collapsing) direction.

This potential problem is solved, in accordance with yet another feature of the present invention, by providing the rear panel 21*b* with removal-facilitating means 50 in the form of a tear-off strip 51 which, while being integral or of one piece with the rear panel 21*b*, is effectively separated from it by a pair of weakened portions 52*a* and 52*b*, such as lines of perforations or compressions of the type that are currently employed on many packages, such as on those in which ice cream is being sold at supermarkets. The strip 51 is provided at least at one of its ends (as shown, the upper one), with a gripping portion or head 53 that can be easily engaged between the fingers of a person trying to remove the insert 20, be it the store owner or personnel or the purchaser of the bag 10, and used to disengage (tear off) the strip 51 in its entirety (or at least a predominant part thereof) from the rest of the rear panel 21*b*.

A complete disassociation of the strip 51 from at least one of the portions into which the strip 51 subdivides the rear panel 21*b* permits each of the resulting insert "halves" to be handled (removed) separately. However, even an incomplete removal of the strip 51 already facilitates the handling of the insert 20 during its removal because it permits the handler to manipulate the two rear panel "halves" into positions (resembling a V) in which they can be quite conveniently gripped and used for extraction of the insert 20 from the interior of the bag 10.

The folding of the side panels 22*a*, 22*b* into juxtaposition with the rear panel 21*b* causes the flexible material of the bag to be folded, and especially the bottom wall 13*a*. Most, if not all, bags have a relatively stiff floor support usually made of a sheet of cardboard material, placed inside the bag above the bottom wall in order to prevent the bottom wall from sagging when articles are carried. The sheet-like, floor support thus serves as an article-supporting shelf, and its stiff nature tends to resist the bottom wall 13*a* from being folded.

This is why, in accordance with another feature of this invention, the floor support is removed from its position overlying the bottom wall and, as identified by the reference numeral 55 in FIG. 5, the floor support 55 is placed in mutual parallelism between the rear panel 21*b* and the rear wall 11*b*. The re-positioning of the floor support occurs when the insert is placed within the bag. The bottom wall 13*a*, now unhindered by the floor support, is free to be folded. Of course, once the insert is removed from the bag, the floor support is moved back onto the bottom wall 13*a* to assume its intended function.

For certain bags, it has been found desirable to form an air passage between the interior and the exterior of the bag to assist the folding and self-deployment of the bag. One of the zippers 15*a*, 15*b* can be at least partially opened, thereby allowing air to exit when the bag is folded to the collapsed state, and also allowing air to enter when the bag is expanded. This air passage or vent helps reduce the strength of the rubberbands that are needed.

The joint simultaneous movement of each side panel 22*a* and 22*b* with its associated side wall 12*a* and 12*b* renders the deployment efficient in operation, because there is no "lost", i.e., relative, movement between the respective side panel and the respective side wall. The strength of the rubberbands need not be as great as would otherwise be required to perform any such lost movement, as well as the movement of the side walls themselves. One need only physically grab with both hands the adjoining edges of the side walls 12*a* and 12*b*, as best seen in FIG. 1, and thereupon pull one's hands apart, to initiate the deployment.

It will further be appreciated especially with reference to FIGS. 1 and 3 that the insert, prior to being deployed, already occupies two corner lines of the bag, as well as the entire rear panel. The movement of the side panels is simply to position the opposing corner lines and the side panels in mutually parallel planes normal to the rear panel.

It will be understood that each of the elements described above, or two or more together, may also find a useful application in other types of constructions differing from the type described above.

While the present invention has been described and illustrated herein as embodied in a specific construction of an expanding insert for a flexible carry-on like, bag or the like, it is not limited to the details of this particular co various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An insert for expanding a bag, comprising:

a) a generally planar, main panel extending between opposite end regions;

b) a generally planar, auxiliary panel hinged at one of the end regions of the main panel for movement between a collapsed position in which the auxiliary panel is juxtaposed against the main panel, and a deployed position in which the auxiliary panel extends substantially perpendicular to the main panel;

c) a corner piece including a pair of generally planar corner parts pivotably joined to one another at a hinge region and individually hinged to the main and auxiliary panels remotely from said one of the end regions; and d) a resilient biasing element connected to said one of the end regions and the corner piece to urge the auxiliary panel to the deployed position by urging one of the corner parts to a substantially parallel relationship with the auxiliary panel in the deployed position, and by simultaneously urging the other of the corner parts to a substantially perpendicular relationship with the auxiliary panel in the deployed position.

2. The insert as defined in claim 1, and further comprising another generally planar, auxiliary panel hinged at the other of the end regions of the main panel for movement between another collapsed position in which the other auxiliary panel is juxtaposed against the main panel, and another deployed position in which the other auxiliary panel extends substantially perpendicular to the main panel; and also comprising another corner piece including another pair of generally planar corner parts pivotably joined to one another at another hinge region and individually hinged to the main and other auxiliary panels remotely from said other of the end regions; and further comprising another resilient biasing element connected to said other of the end regions and the other corner piece to urge the other auxiliary panel to the other deployed position by urging one of the corner parts of the other corner piece to a substantially parallel relationship with the other auxiliary panel in the other deployed position, and by simultaneously urging the other of the corner parts of the other corner piece to a substantially perpendicular relationship with the other auxiliary panel in the other deployed position.

3. The insert as defined in claim 2, wherein each of the end regions of the main panel has a promontory, and wherein each of the hinge regions of the corner pieces has another promontory, and wherein each of the biasing elements is connected between the promontories.

4. The insert as defined in claim 3, wherein each of the biasing elements is an endless elastic element trained around the promontories.

5. The insert as defined in claim 2, wherein each of the end regions of the main panel has a pair of promontories, and wherein each of the hinge regions of the corner pieces has another pair of promontories; and wherein each of the biasing elements is connected between a respective promontory of a respective end region and a respective promontory of a respective hinge region.

6. The insert as defined in claim 5, wherein each of the biasing elements is an endless elastic element trained around the respective promontory of the respective end region and the respective promontory of the respective hinge region.

7. The insert as defined in claim 1, wherein said one corner part is integral with the main panel, and wherein said other corner part is integral with the auxiliary panel.

8. The insert as defined in claim 1, wherein the panels and corner piece are constituted of a single blank of corrugated board material.

9. The insert as defined in claim 1, and further comprising destructible separation means incorporated in the main panel for separating the main panel into separate pieces.

10. A bag assembly, comprising:

a) a bag expandable from a collapsed state to an expanded state, said bag having a main wall and a pair of end walls foldable onto the main wall in the collapsed state, and foldable away from the main wall in the expanded state, b) an insert accommodated within the bag for expanding the bag, including i) a generally planar, main panel in mutual contact with the main wall and extending between opposite end regions, and ii) a generally planar, auxiliary panel hinged at one of the end regions of the main panel for movement between a collapsed position in which the auxiliary panel is juxtaposed against the main panel, and a deployed position in which the auxiliary panel extends substantially perpendicular to the main panel, said auxiliary panel being in continuous mutual contact with one of the end walls of the bag throughout said movement between the collapsed and deployed positions;

c) a corner piece including a pair of generally planar corner parts pivotably joined to one another at a hinge region and individually hinged to the main and auxiliary panels remotely from said one of the end regions; and d) a resilient biasing element connected to said one of the end regions and the corner piece to urge the auxiliary panel to the deployed position by urging one of the corner parts to a substantially parallel relationship with the auxiliary panel in the deployed position, and by simultaneously urging the other of the corner parts to a substantially perpendicular relationship with the auxiliary panel in the deployed position.

11. The assembly as defined in claim 10, and further comprising another generally planar, auxiliary panel hinged at the other of the end regions of the main panel for movement between another collapsed position in which the other auxiliary panel is juxtaposed against the main panel, and another deployed position in which the other auxiliary panel extends substantially perpendicular to the main panel; and also comprising another corner piece including another pair of generally planar corner parts pivotably joined to one another at another hinge region and individually hinged to the main and other auxiliary panels remotely from said other of the end regions; and further comprising another resilient biasing element connected to said other of the end regions and the other corner piece to urge the other auxiliary panel to the other deployed position by urging one of the corner parts of the other corner piece to a substantially parallel relationship with the other auxiliary panel in the other deployed position, and by simultaneously urging the other of the corner parts of the other corner piece to a substantially perpendicular relationship with the other auxiliary panel in the other deployed position.

12. The assembly as defined in claim 11, wherein each of the end regions of the main panel has a promontory, and wherein each of the hinge regions of the corner pieces has another promontory, and wherein each of the biasing elements is connected between the promontories.

13. The assembly as defined in claim 12, wherein each of the biasing elements is an endless elastic element trained around the promontories.

14. The assembly as defined in claim 11, wherein each of the end regions of the main panel has a pair of promontories, and wherein each of the hinge regions of the corner pieces has another pair of promontories; and wherein each of the biasing elements is connected between a respective promontory of a respective end region and a respective promontory of a respective hinge region.

15. The assembly as defined in claim 14, wherein each of the biasing elements is an endless elastic element trained around the respective promontory of the respective end region and the respective promontory of the respective hinge region.

16. The assembly as defined in claim 10, wherein said one corner part is integral with the main panel, and wherein said other corner part is integral with the auxiliary panel.

17. The assembly as defined in claim 10, wherein the panels and corner piece are constituted of a single blank of corrugated board material.

18. The assembly as defined in claim 10, and further comprising destructible separation means incorporated in the main panel for separating the main panel into separate pieces.

* * * * *